United States Patent [19]

Kudalkar

[11] 4,337,888

[45] Jul. 6, 1982

[54] NON-GLUED MANUFACTURERS JOINT

[75] Inventor: Kishor N. Kudalkar, Carol Stream, Ill.

[73] Assignee: Weyerhaeuser Company, Tacoma, Wash.

[21] Appl. No.: 254,002

[22] Filed: Apr. 13, 1981

[51] Int. Cl.[3] ..... B65D 5/10; B65D 5/42

[52] U.S. Cl. ..... 229/48 R; 229/37 R; 229/39 R

[58] Field of Search ..... 229/48 R, 48 SA, 38, 229/39 R, 44 R, 37 R

[56] References Cited

U.S. PATENT DOCUMENTS

| | | | |
|---|---|---|---|
| 2,190,433 | 2/1940 | Palmer | 229/37 R |
| 2,361,124 | 10/1944 | Ringholz | 229/39 R |
| 2,675,168 | 4/1954 | Clark | 229/44 R |
| 2,944,717 | 7/1960 | Lynch | 229/23 R |
| 3,037,684 | 6/1962 | Andrews et al. | 229/45 R |
| 3,061,168 | 10/1962 | Galloway | 229/39 R |
| 3,415,585 | 12/1966 | Morris | 312/261 |
| 3,451,535 | 6/1969 | Caplan | 229/39 R |
| 3,625,412 | 12/1971 | Rosenburg, Jr. | 229/39 R |

FOREIGN PATENT DOCUMENTS

| | | | |
|---|---|---|---|
| 645132 | 7/1962 | Canada | 229/39 R |

*Primary Examiner*—William Price
*Assistant Examiner*—Gary E. Elkins
*Attorney, Agent, or Firm*—Weyerhaeuser Company

[57] ABSTRACT

A manually formed manufacturer's joint for a container is formed on opposite end edges of the container. A first hinged flap is on one end and a hinged panel is on the opposite end. The panel has an aperture formed by a second hinged flap. The aperture opens toward the panel hinge. The aperture has a maximum width slightly larger than the maximum width of the first flap and a minimum width equal to the width of the first flap hinge. The first flap is inserted through the aperture and the shoulders of the first flap lock behind the panel. The first flap is held in locked position by the second flap being rotated into the plane of the panel.

2 Claims, 4 Drawing Figures

NON-GLUED MANUFACTURERS JOINT

BACKGROUND OF THE INVENTION

1. Field of the Invention

A locking structure for a container.

2. Review of the Prior Art

A typical locking structure for a container is shown by Lynch, U.S. Pat. No. 2,944,717 which issued July 12, 1960. In this construction a tab 28 on one panel extends through a cut 32 on the opposing panel. A similar construction is shown in Andrews, et al, U.S. Pat. No. 3,037,684 issued June 5, 1962. In this construction the tab is 45 and the cut is 40.

Morris, U.S. Pat. No. 3,415,585 which issued Dec. 10, 1968 discloses a standard glued manufacturer's joint. This is panel 7 in FIG. 1 which is glued to panel 6 in the completed container as shown in FIG. 8.

SUMMARY OF THE INVENTION

Often, a glued manufacturer's joint is inappropriate for a particular container. It may be so when the glued manufacturer's joint is very difficult or impossible to be formed with the help of standard production machinery. The examples being the intricate die-cut boxes and boxes with small dimensions which cannot be processed on standard production machinery because of intricacy or dimensions.

The inventor decided that it would be necessary to provide a container in which the manufacturer's joint could be formed by hand with ease while the container is formed. This would be useful in applications as mentioned above and also where it is desirable to store the blanks in lay-flat condition prior to use.

He devised a system in which a first flap hinged to one end of the blank fits through an aperture in a panel hinged to the opposing end of the blank. The aperture is formed by a second flap. The first flap has shoulders adjacent its hinge and the aperture is shaped to allow the first flap to be inserted through the aperture and to allow the shoulders to lock behind the panel. The second flap is rotated into the plane of the panel to lock the first flap in place and create a manufacturer's joint.

DESCRIPTION OF THE PREFERRED EMBODIMENT

Figure 1:
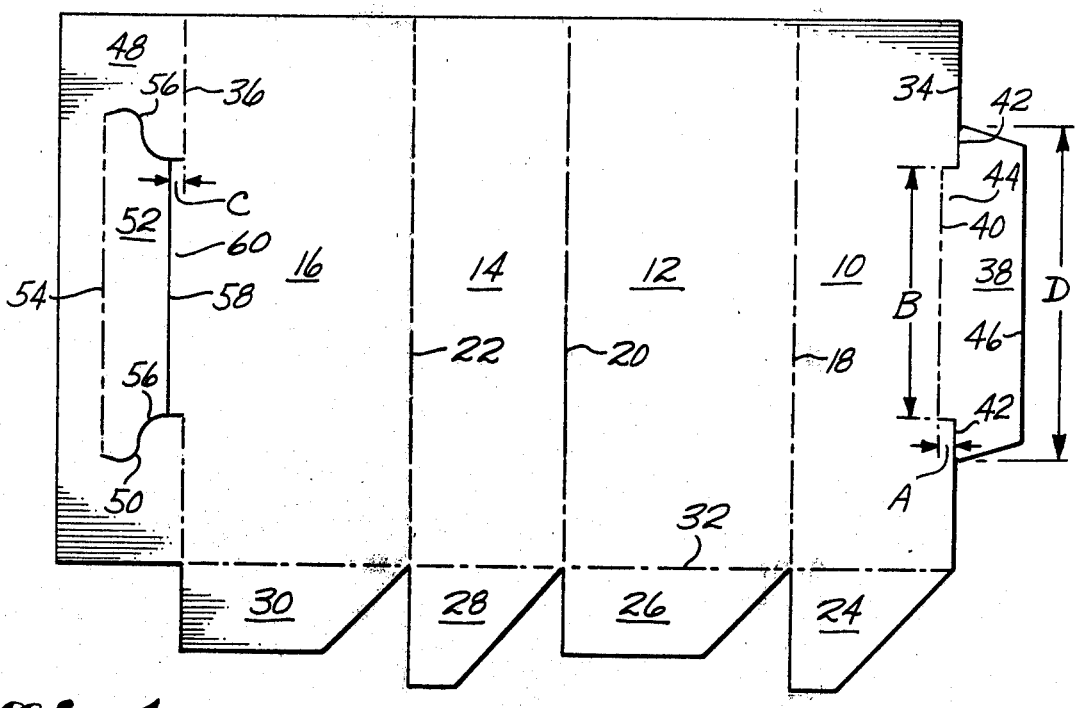
FIG. 1 is a top plan view of a container blank.
Figure 2:
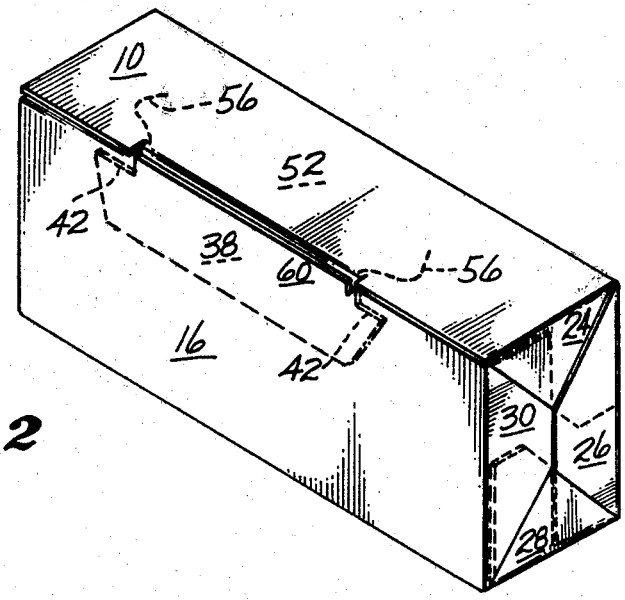
FIG. 2 is an isometric view of the closed container.
Figure 3:
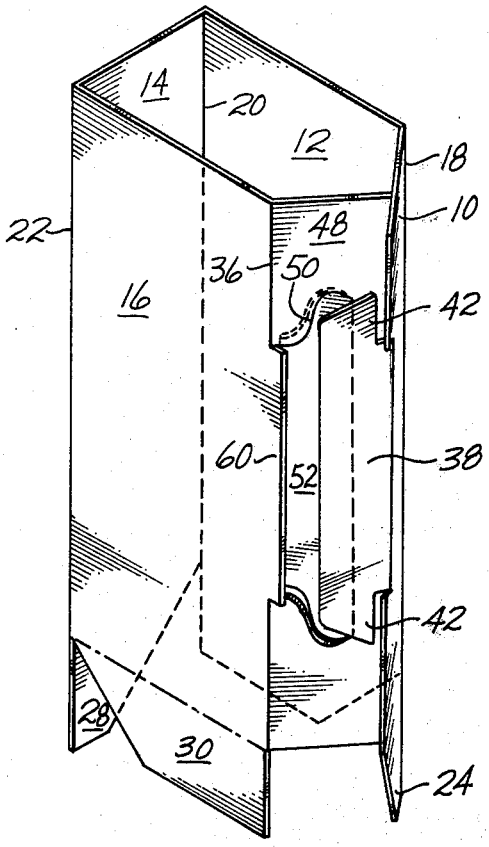
FIGS. 3–4 are isometric views showing the container being formed.
Figure 4:
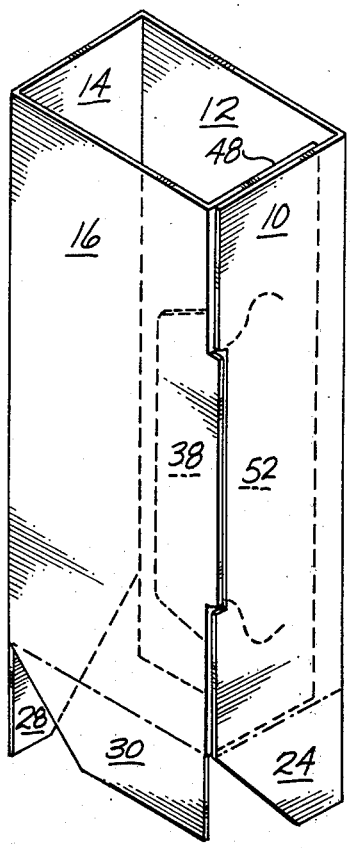

The blank in FIG. 1 has side walls 10, 12, 14 and 16 hingedly joined by transverse score lines 18, 20, and 22. End flaps 24, 26, 28 and 30 are joined to one end of the side walls along score line 32.

The purpose of the present invention is to join the side wall 10 to the opposing side wall 16 along the outer edge 34 of end wall 10 and the outer edge 36 of end wall 16. This is done by the locking mechanism attached to walls 10 and 16. Wall 10 has a first flap 38 hinged to the wall along score line 40. Score line 40 is parallel to the outer edge 34 and may be offset inwardly of the edge a distance A, approximately twice the width of the board which forms the container. For most corrugated containers this distance would be approximately ¼ of an inch. The length of score line 40 is a distance B. This distance is less than the full length of edge 34.

The first flap 38 also has a pair of locking shoulders 42. These are adjacent to and parallel with the score line 40 and offset from the score line 40 the distance A. A neck or offset section 44 extends between the score line 40 and the shoulders 42. The length of the neck 42 is the same distance B as the length of score line 40. Usually the neck 44 and the shoulders 42 are formed by a slit between the flap 38 and the wall 10 as shown in FIG. 1.

The first flap 38 is longest across the shoulders 42. The first flap 38 is usually tapered from the outer ends of shoulders 42 towards its outer edge 46.

The locking structure on the opposing side wall 16 is the panel 48 hinged to side wall 16 along the score line which forms the outer edge 36 of the wall. An aperture 50 is formed in panel 48 by a second flap 52. The second flap 52 is hinged to panel 48 along score line 54. Score line 54 is located centrally of the panel 48 and is parallel to score line 36. The second flap 52 extends from the score line 54 toward score line 36, and is formed by slits or cut lines 56 which extend between the score line 54 and the score line 36 and a slit 58 which extends between slits 56, is parallel to the score line 36 and offset outwardly from the score line 36 a distance C. The two slits 56 are parallel between slit 58 and score line 36 and form projection 60 on side wall 16. The distance C between slit 58 and score lines 36 is equal to or slightly smaller than distance A so that neck 44 may fit in the aperture formed in panel 48 by projection 60.

At its widest, the aperture 50 is slightly larger than the distance D which is the maximum width of the first flap 38. The aperture 50 becomes narrower in between score lines 36 and slit 58 and is equal to the distance B. This allows first flap 38 to be inserted through aperture 50.

In forming the manufacturer's joint, the panel 48 is bent around score lines 36 at approximately 90° to the panel 16. The first flap 38 is then bent around score line 40 and is inserted through aperture 50 thereby bending the second flap 52 around score line 52. The first flap 38 is then pushed against the inner face of wall 16. The neck 44 of the first flap 38 will be within the aperture formed in panel 48 by projection 60. The shoulders 42 will be locked behind panel 48. The second flap 52 is rotated into the plane of the panel 48 to lock first flap 38 against panel 16.

In a long container a series of locking elements may be used.

The container may have end flaps on both ends of the side walls.

The usual material of construction is double faced corrugated paperboard.

I claim:

1. A manually formed manufacturer's joint for a container comprising a first flap hinged along a score line to one end of said container, the length of said first flap hinge being less than the full length of the end of container, said first flap having a pair of shoulders offset outwardly from said hinge a distance substantially equal to twice the width of the material forming the container, the length of said offset section being equal to the length of said hinge and the length of said first flap at said shoulders being the maximum length of said first flap, a panel hingedly joined along a score line to the opposite end of said container, a second flap within and hinged along a score line to said panel, said second flap hinge being within said panel and parallel to said opposite end, said second flap further being formed by a pair of side cuts in said panel extending from each end of said second flap hinge to said panel hinge, and an end cut extending between said two side cuts and being offset from said panel hinge a distance substantially equal to twice the width of said material forming said container, the length of said end cut being at least equal to the length of said first flap offset section and the panel side cuts being parallel between said end cut and said panel hinge to form a projection on said container end, and the maximum width of said second flap being slightly larger than the maximum width of said first flap, whereby said first flap may be inserted through said aperture, its offset section may fit within the aperture formed by said projection and it may be locked in place by said second flap being rotated into the plane of said panel.

2. The article of claim 1 in which said first flap hinge is inset into said container from said one end a distance equal to said offset.

* * * * *